US012781745B2

(12) United States Patent
Kroczek et al.

(10) Patent No.: US 12,781,745 B2
(45) Date of Patent: Nov. 3, 2026

(54) ROTARY VANE PUMP VANE WEAR DETECTION

(71) Applicant: B/E Aerospace, Inc., Winston Salem, NC (US)

(72) Inventors: Piotr Jacek Kroczek, Nieciszów (PL); Paweł Jerzy Świrniak, Wrocław (PL); Krzysztof Słomiany, Wrocław (PL)

(73) Assignee: B/E AEROSPACE, INC., Winston Salem, NC (US)

( * ) Notice: Subject to any disclaimer, the term of this patent is extended or adjusted under 35 U.S.C. 154(b) by 0 days.

(21) Appl. No.: 19/054,544

(22) Filed: Feb. 14, 2025

(65) Prior Publication Data

US 2025/0270996 A1 Aug. 28, 2025

(30) Foreign Application Priority Data

Feb. 23, 2024 (EP) ..... 24461535

(51) Int. Cl.
*F04C 28/28* (2006.01)
*F04C 18/344* (2006.01)
*F01C 21/08* (2006.01)

(52) U.S. Cl.
CPC ..... *F04C 28/28* (2013.01); *F04C 18/3441* (2013.01); *F01C 21/0809* (2013.01);
(Continued)

(58) Field of Classification Search
CPC .. F04C 28/28; F04C 18/3441; F04C 2240/30; F04C 2240/81; F04C 2270/16;
(Continued)

(56) References Cited

U.S. PATENT DOCUMENTS 3,463,384 A * 8/1969 Kilbane ..... F04C 28/28 418/2
3,479,640 A * 11/1969 Puma ..... F16D 66/026 200/61.4

(Continued)

FOREIGN PATENT DOCUMENTS

DE 102018218653 4/2020
RU 2371585 10/2009

OTHER PUBLICATIONS

European Patent Office, European Search Report dated Aug. 8, 2024 in Application No. 24461535.7.

*Primary Examiner* — Charles G Freay
(74) *Attorney, Agent, or Firm* — SNELL & WILMER L.L.P.

(57) ABSTRACT

An assembly for detecting wear of a vane of a rotary vane pump, the assembly comprising: a vane configured to be mounted in a radial slot of a rotor of a rotary vane pump, the vane having a vane body of non-electrically conductive material, the vane body having a radially outer end that, in use, extends to contact an electrically earthed housing of the rotor; an electrically conductive sensor element housed within the vane body, the sensor element being electrically connected to a positive electric potential (+) and having an electrically conductive tip that becomes exposed as the vane body radially outer end wears, to make electrical contact with the housing, in use, such as to create a closed electrical circuit between the positive potential and the earthed housing, to generate an electrical signal indicative of wear of the vane.

11 Claims, 4 Drawing Sheets

(52) U.S. Cl.
CPC ..... *F04C 2240/30* (2013.01); *F04C 2240/81* (2013.01); *F04C 2270/16* (2013.01); *F04C 2270/80* (2013.01); *F04C 2270/86* (2013.01)

(58) Field of Classification Search
CPC ..... F04C 2270/80; F04C 2270/86; F01C 21/0809; G01M 5/0033
USPC ..... 340/679; 73/7
See application file for complete search history.

(56) References Cited

U.S. PATENT DOCUMENTS

| | | | | |
|---|---|---|---|---|
| 3,805,228 | A * | 4/1974 | Peeples | F16D 66/027 200/61.4 |
| 5,015,990 | A * | 5/1991 | Reede | F16D 66/024 188/DIG. 1 |
| 6,752,604 | B2 * | 6/2004 | Althouse | F04C 2/3441 418/2 |
| 6,769,886 | B2 | 8/2004 | Henderson | |
| 6,913,451 | B2 | 7/2005 | Hedrick et al. | |
| 9,828,992 | B2 | 11/2017 | Stambaugh et al. | |
| 2004/0136852 | A1 | 7/2004 | Hedrick et al. | |
| 2011/0169651 | A1 | 7/2011 | Mitchell et al. | |
| 2022/0356880 | A1 * | 11/2022 | Beierlein | F01C 21/0809 |

* cited by examiner

ROTARY VANE PUMP VANE WEAR DETECTION

CROSS-REFERENCE TO RELATED APPLICATIONS

This application claims priority to EP patent application Ser. No. 24/461,535.7, filed Feb. 23, 2024 and titled "ROTARY VANE PUMP VANE WEAR DETECTION," which is incorporated by reference herein in its entirety for all purposes

FIELD

The present disclosure is concerned with an arrangement for detecting wear of vanes in a rotary vane pump.

BACKGROUND

Sliding rotary vane pumps are used in a range of applications, including applications operating in extreme environments, such as vacuum pumps used in aircraft. Typically, rotary vane pumps now in use are dry vacuum pumps (i.e. without the use of an oil lubricant). Such rotary vane pumps typically have a rotor in which radial slots are formed and within which vanes are slidably mounted to reciprocate within the slots—extending and retracting relative to the slots—as the rotor rotates. The vanes are usually made of a carbon or carbon-composite material, often with a self-lubricating coating to reduce wear of the vane. Even with such materials/coatings, the constant reciprocal movement of the vanes, together with the often harsh environmental factors such as ice and debris, causes the vanes to wear and lose length during operation of the pump. Eventually, the length of the vane is so short that the vane can fall out of the slot or not reciprocate properly and the pump will no longer operate properly. Wear of the vanes can, therefore, cause the pump to fail and/or can cause damage to the pump. In many applications, including in aviation, the consequences can be catastrophic.

Research has found the degree of wear that can lead to pump failure and steps have to be taken to avoid the vanes wearing to such an extent. Conventionally, vanes have been removed and replaced based on the amount of time they have been in use. Because wear is not always linear, though, and can accelerate, such monitoring needs to be extremely conservative and may result in vanes being replaced even if they are not worn to a problematic degree. Alternatively, vanes can be examined at periodic maintenance intervals to determine their degree of wear, but this requires the pump to be disassembled during down time of the pump and is time and labor intensive. U.S. Pat. No. 6,769,886 B2 teaches a method of monitoring for wear of vanes without needing to disassemble the pump, using a measuring stylus that is inserted into an access port in the pump housing to monitor the length of the vanes according to the length of insertion of the stylus in the access port to contact the vane. Whilst this solution allows for an individual determination of the wear of each vane and can be performed without needing to disassemble the pump, this measurement can still only be performed during down time of the pump (and when the pump is disassembled from e.g. the aircraft). Furthermore, the wear measurement is not precise and conservative criteria need to be applied when deciding whether a vane needs to be replaced due to the lack of accuracy.

There is a desire for an assembly for more precisely measuring wear of individual vanes of a rotary vane pump during operation of the pump.

SUMMARY

According to the present disclosure, there is provided an assembly for detecting wear of a rotary vane pump vane. In one aspect, there is provided an assembly for detecting wear of a vane of a rotary vane pump, the assembly comprising: a vane configured to be mounted in a radial slot of a rotor of a rotary vane pump, the vane having a vane body of non-electrically conductive material, the vane body having a radially outer end that, in use, extends to contact an electrically earthed housing of the rotor; an electrically conductive sensor element housed within the vane body, the sensor element being electrically connected to a positive electric potential and having an electrically conductive tip that becomes exposed as the vane body radially outer end wears, to make electrical contact with the housing, in use, such as to create a closed electrical circuit between the positive potential and the earthed housing, to generate an electrical signal indicative of wear of the vane.

In another aspect, there is provided a rotary vane pump incorporating such an assembly.

BRIEF DESCRIPTION OF THE DRAWINGS

Examples of the wear detection assembly according to the disclosure are described with reference to the drawings. It should be noted that these are examples only and that variations are possible within the scope of the claims;

DETAILED DESCRIPTION

The solution provided by this disclosure to detecting wear of a vane involves providing an electrically conductive sensor within the body of the vane. The body of the sensor is connected to a positive electrical potential. This may be by one end of the sensor extending from the radially inner end of the vane and being connected to a positive electrical potential. The other end of the sensor is contained within the body of the vane such that in a non-worn state, the sensor is covered or encased by the non-electrically conductive material of the vane and is not exposed. As the vane wears, the vane shortens which means that the amount of vane material covering the sensor reduces until, at a predetermined degree of wear, the sensor becomes exposed at the radially outer end of the vane. When the sensor is exposed, it makes electrical contact with the rotor housing, which is electrically earthed. This then closes an electrical circuit from the positive electrical potential at the radially inner end of the sensor, through the sensor, to the earthed housing. The closed electrical circuit generates a signal indicative of the exposure of the sensor i.e. that the length of the vane has shorted to the predetermined degree of wear. In the description, a non-worn state means that the wear on the vane is not sufficient to satisfy the predetermined degree of wear, which could be zero wear or any amount of wear less than the predetermined degree of wear.

Figure 1:
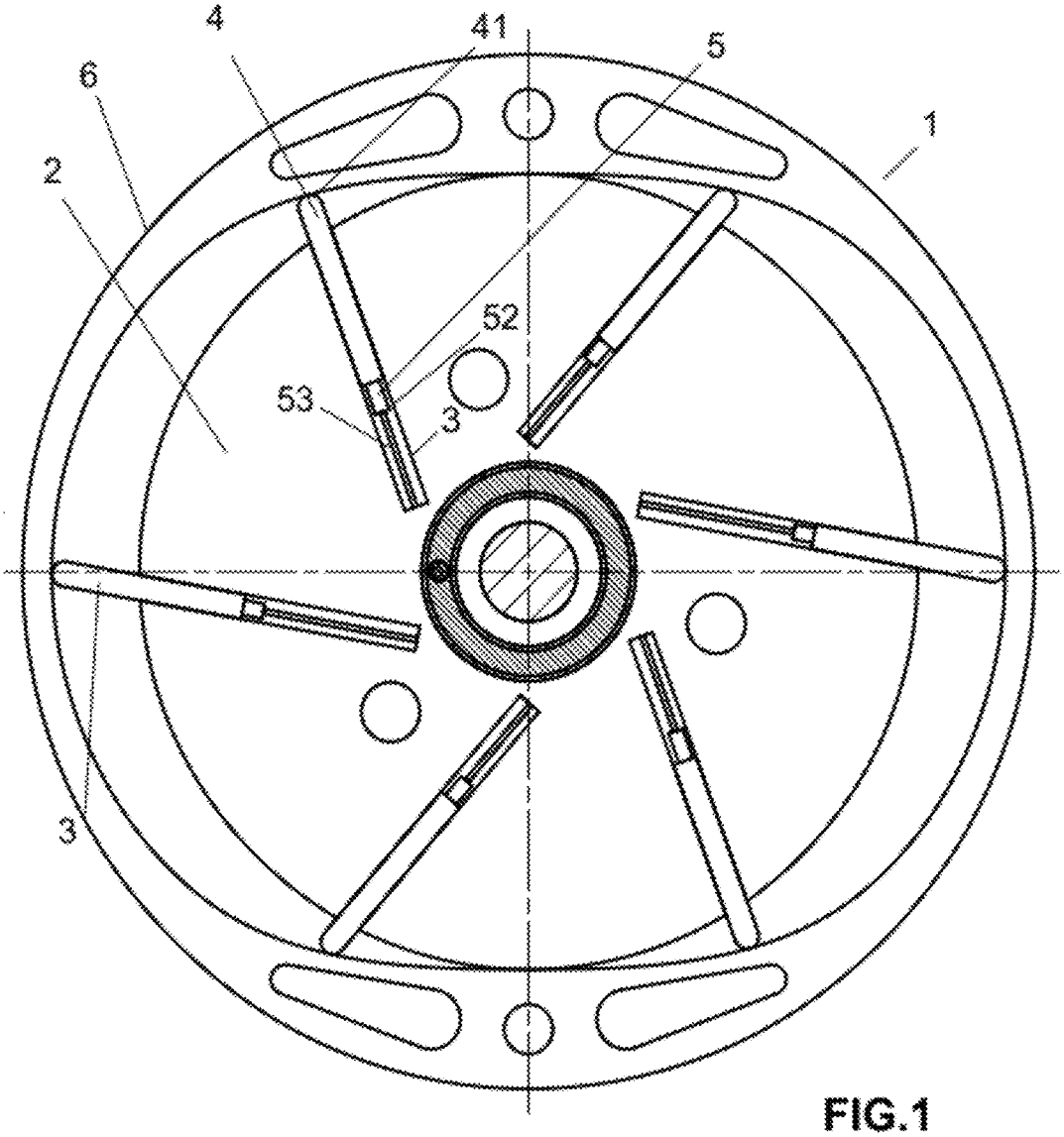
FIG. 1 shows an example of a wear detection assembly according to the disclosure incorporated into a rotary vane pump.

An example of the wear detection assembly is shown in FIG. 1 which shows a rotary vane pump 1 having a rotor 2 rotatable within a housing 6. As is known, radial slots 3 are provided around the rotor, within which are mounted, for reciprocal radial movement, vanes 4. As the rotor rotates relative to the housing 6, the vanes 4 synchronously extend from and retract into their respective slots 3, making contact with the housing 6 when extended. The housing 6 is electrically earthed.

As mentioned above, during the life of the pump, the vanes 4 will become worn and will shorten such that eventually they may fall out of the slots when extending. It is important to detect wear of the vanes before they have become so worn that failure occurs—i.e. a predetermined degree of wear, such that when the vanes have reached that degree of wear, they can be replaced.

According to this disclosure, the wear of the vanes 4 is detected using an electrically conductive sensor element 5 located within the body of the vane 4. The sensor is located in the vane body 4, which is electrically non-conductive, such that a tip 51 of the sensor 5 is located at a position along the length L of the vane 4 which corresponds to the length of the vane when worn to the predetermined degree of wear. In other words, the tip 51 of the sensors is spaced from the radially outer end 41 of the vane 4 by a distance w corresponding to the permitted amount of wear of the vane 4 from the radially outer end before the predetermined degree of wear is reached. As the vane becomes worn, distance w decreases.

The electrically conductive sensor element 5 is electrically connected to a positive electrical potential. In the example shown, the sensor element has a radially inner end 52 that is connected by an electrical conductor 53 to the positive potential as will be described further below but other configurations of the sensor 5 are possible, provided it has a tip located at the wear distance w within the vane body and it is connected to a positive electrical potential.

Figure 2:
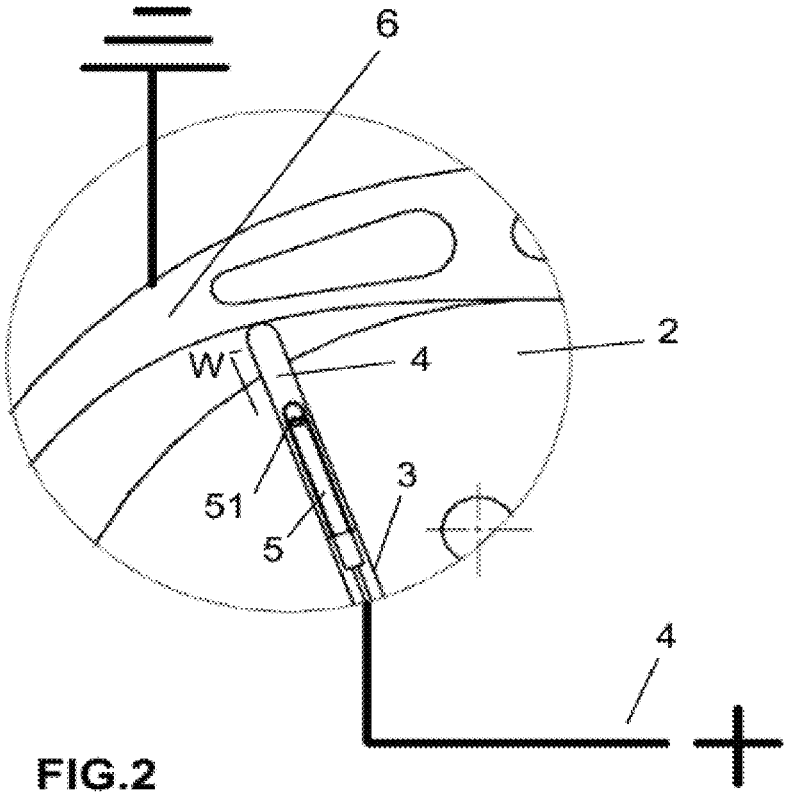
FIG. 2 shows a section of the pump of FIG. 1 where the vane is not worn to such a degree that an indication of wear is provided by the wear detection assembly.

In the example shown in FIG. 1, the tip 51 of the sensor element 5 of each vane 4 is covered by the material of the vane body as the vanes are not worn down to the predetermined degree of wear. This state is also shown in more detail in FIG. 2 which shows a section of the housing 6 which is earthed, a section of the rotor 2 with a slot 3, a vane 4 mounted in the slot and a wear sensor element 5 connected to a positive electrical potential (+) and encased within the body of the vane. Because the tip 51 of the sensor is encased in the non-conductive material of the vane 4 it acts as an open circuit and so no wear signal is generated.

Figure 3:
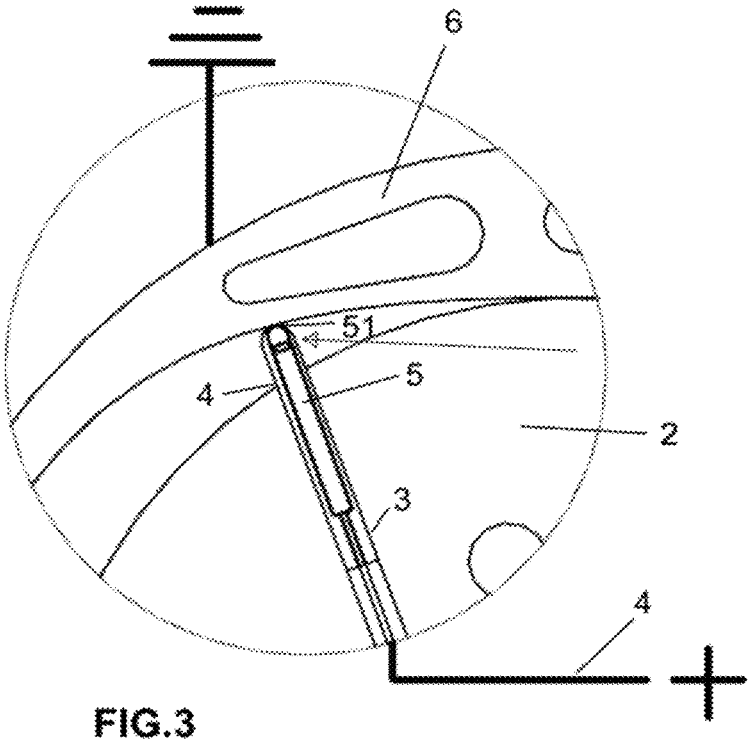
FIG. 3 shows a section of the pump of FIG. 1 where the vane is worn to such a degree that an indication of wear is provided by the wear detection assembly.

FIG. 3 illustrates that sensor when the vane has become worn to the predetermined degree of wear, i.e. the distance w has become zero and the tip 51 of the sensor element 5 has become exposed from the end of the vane 4 as the non-conductive material at the radially outer vane end 41 has worn away. In this state, as the vane extends from the slot 3, the electrically conductive tip 51 of the sensor 5 makes electrical contact with the earthed housing this closing the circuit from the positive potential to earth. The closed electrical circuit generates a signal indicative of wear of the vane 4, as an indication that the vane requires replacement.

Figure 4:
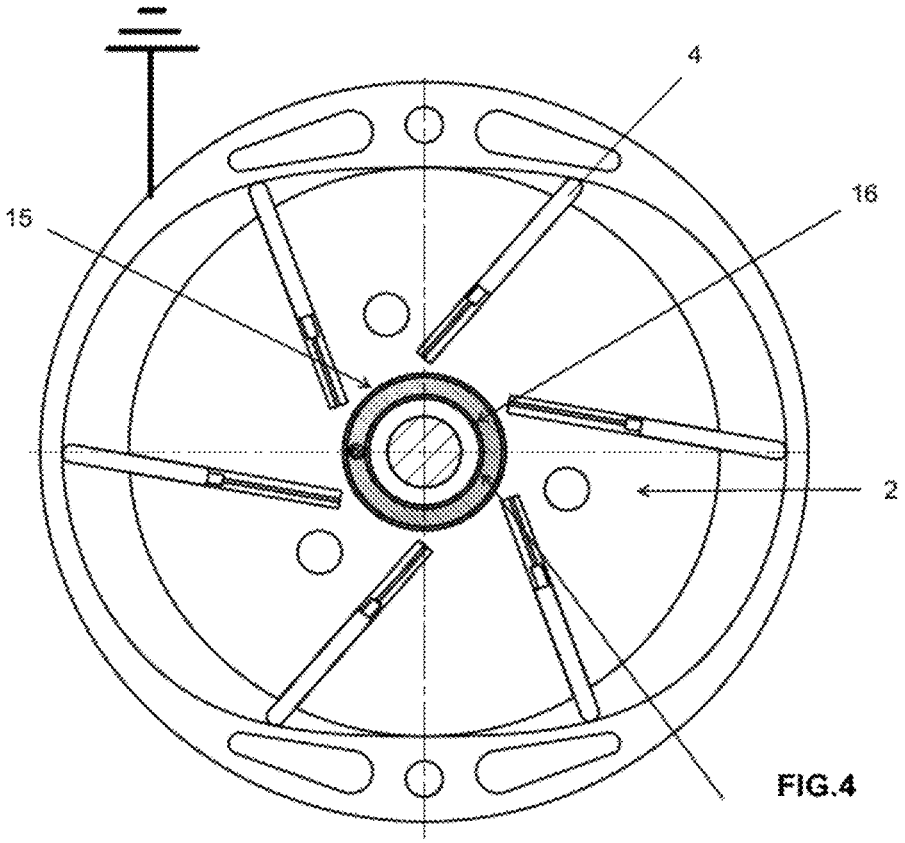
FIG. 4 is a more detailed view of a pump such as shown in FIG. 1.
Figure 5:
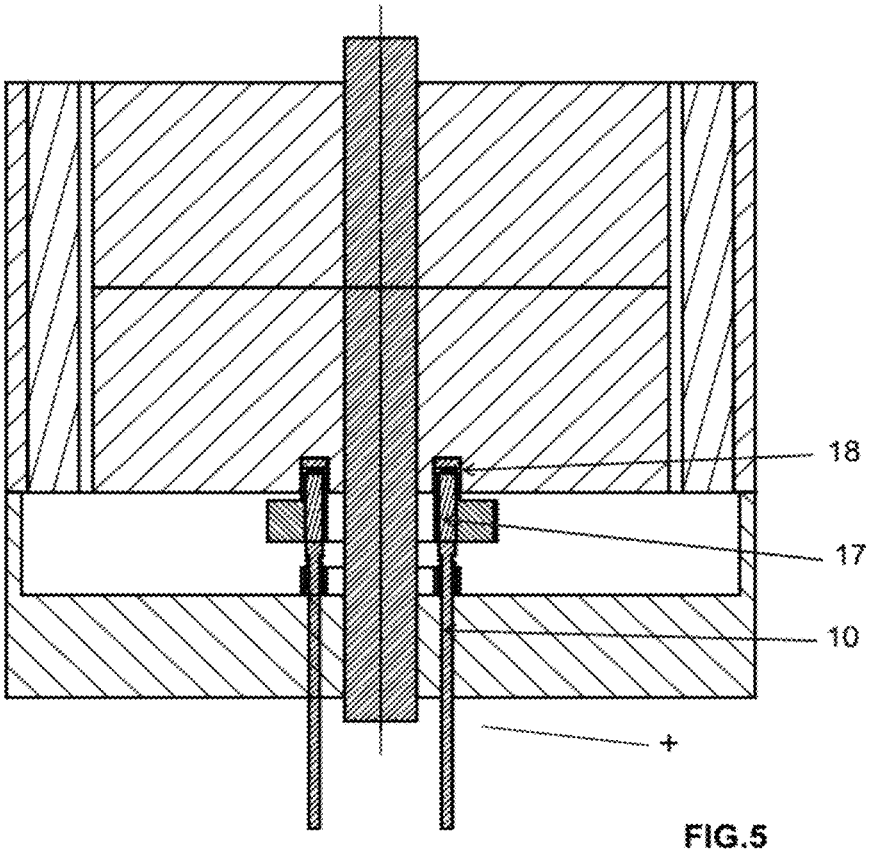
FIG. 5 is a close up of a detail of FIG. 4.

An example of how the sensor elements 5 are connected to the positive potential + is illustrated in FIGS. 4 and 5. Here the vanes 4, containing the sensor element 5, are connected to a rotor base plate 16 via a joint 15. The joint 15 is connected to a sleeve 17 at a connection point 18. The sleeve 17 is arranged to rotate with the rotor 2 whereby the positive electric potential is transferred by an electric brush 10. Other ways may be envisaged to connect the sensor element to a positive electrical potential.

Figure 6:
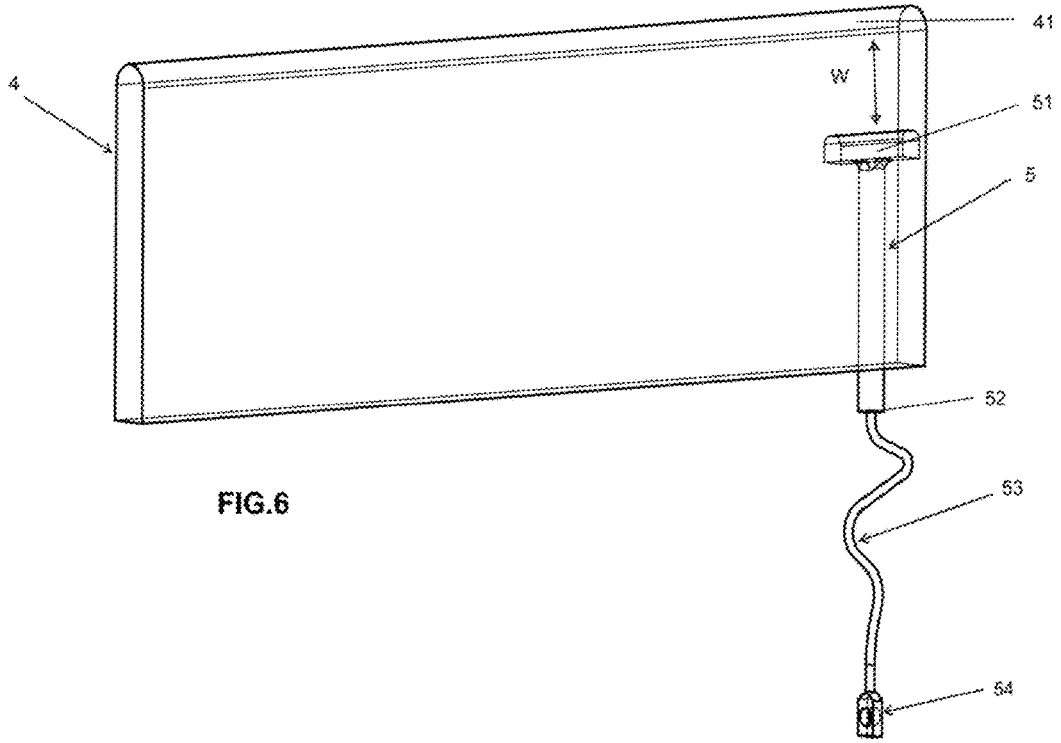
FIG. 6 shows one example of a sensor mounted within a vane according to the disclosure.

FIG. 6 shows one example of a sensor 5 incorporated into the vane 4 according to this disclosure. In this example, the sensor element 5 is essentially T-shaped with the tip 51 forming the top of the T-shape and located at a distance w from the radially outer end 41 of the vane, where w decreases as the vane wears. The sensor element 5 is made of electrically conductive material such as (but not limited to) copper. The sensor element 5 can be located in the body of the vane 4 is different ways, for example by overmolding the vane 4 onto the sensor element 5 or by creating a groove in the vane and securing the sensor element in the groove e.g. fixing it in place by adhesive. The radially inner end 52 of the sensor element 5 is connected to the positive potential e.g. by a conductor such as a wire 53 and a connector 54.

Figure 7:
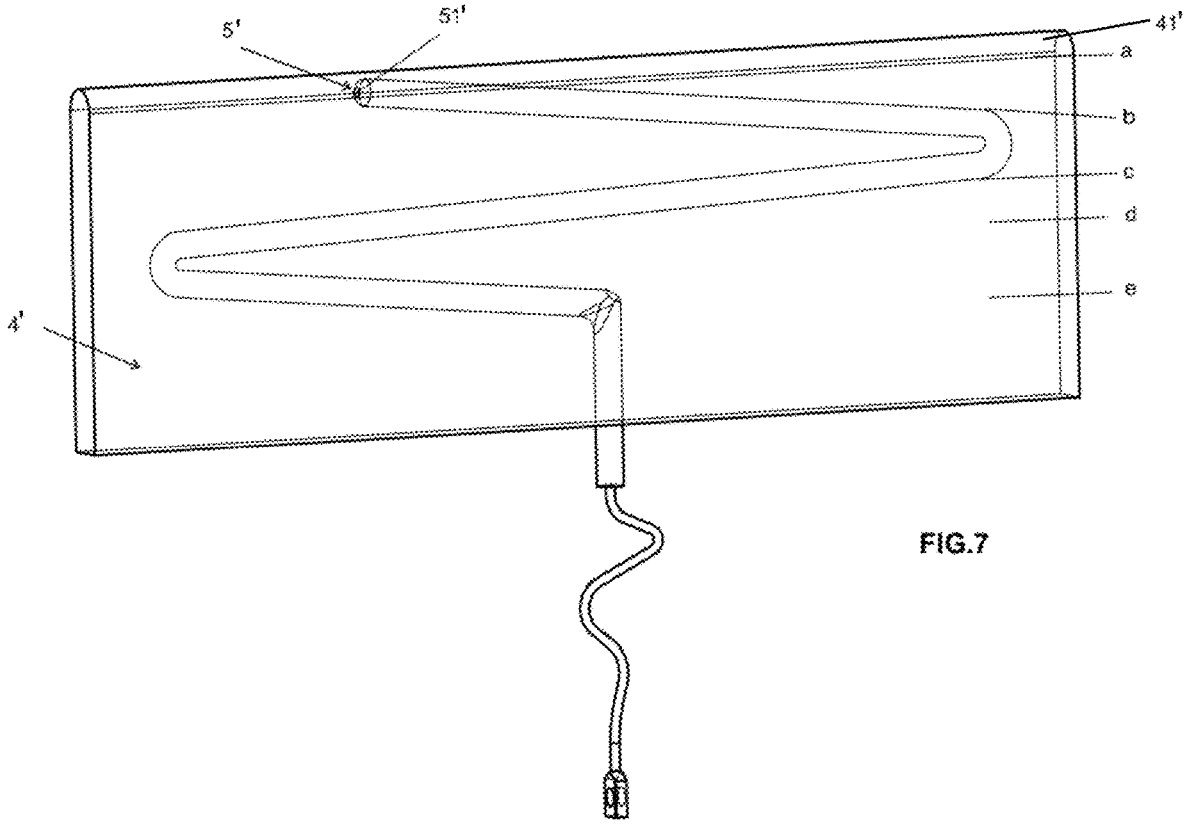
FIG. 7 shows an alternative example of a sensor mounted within a vane according to the disclosure.

In an alternative example, the sensor element 5' is arranged such that it also wears as the vane 4' wears so that an indication of the degree of wear of the vane can be provided as an electrical signal during operation, as the wear occurs, even before the critical predetermined degree of wear has been reached. In this example, the sensor element 5' is located in the body of the vane such that it has a tip 51' at the radially outer end 41' of the vane during the entire life of the vane and so the electrically conductive sensor always electrically contacts the housing 6. The shape of the sensor 5 is such that as the vane wears and, at the same time, the sensor tip is worn, the sensor also becomes shorter and its electrical resistance therefore changes. In the example shown, the sensor 5' has a spiral shape. The resistance of the sensor 5' will decrease from a to e of FIG. 7 due to the changing length of the sensor 5' as it wears over time. By monitoring the resistance of the sensor, it is possible to obtain an indication of the wear of the sensor and, hence, wear of the vane 4'.

The wear detection assembly of this disclosure allows wear of the vanes to be monitored separately for each vane and during operation of the pump without needing to disassemble the pump or dismount it from its environment (e.g. an aircraft). The assembly provides a precise indication of wear which means that the vanes are not replaced too soon, and so their life, and time between replacement, is maximized. In one example, wear of the vane can be monitored in real time which can assist with service planning.

What is claimed is:

1. An assembly for detecting wear of a vane of a rotary vane pump, the assembly comprising:

a vane configured to be mounted in a radial slot of a rotor of a rotary vane pump, the vane having a vane body of non-electrically conductive material, the vane body having a radially outer end that, in use, extends to contact an electrically earthed housing of the rotor;

an electrically conductive sensor element housed within the vane body, the sensor element being electrically connected to a positive electric potential (+) by an electric brush and having an electrically conductive tip that becomes exposed as the vane body radially outer end wears, to make electrical contact with the housing, in use, such as to create a closed electrical circuit between the positive potential and the earthed housing, to generate an electrical signal indicative of wear of the vane, wherein the assembly is connected to a base plate via a joint, wherein the joint is connected to a sleeve that rotates with the rotor such that the positive potential is transferred by the electric brush.

2. The assembly of claim 1, wherein the tip of the sensor element is located a distance from the radially outer end of the vane corresponding to a predetermined degree of wear of the vane.

3. The assembly of claim 2, wherein the sensor element is T-shaped and the tip is the top of the T-shape.

4. The assembly of claim 1, wherein the tip of the sensor extends to the radially outer end of the vane and the sensor wears together with the vane such that the length of the sensor shortens as the vane wears, and wherein the electrical signal indicative of wear of the vane varies based on the resistance of the sensor that varies as the length of the sensor varies.

5. The assembly of claim 4, wherein the sensor is arranged to have a spiral shape within the body of the vane.

6. The assembly of claim 1, wherein the sensor is connected to the positive potential via an electrical conductor at an end of the sensor opposite the tip.

7. The assembly of claim 6, further comprising a connector to electrically connect the conductor to the positive potential.

8. The assembly of claim 1, wherein the sensor element is made of copper.

9. The assembly of claim 1, wherein the sensor element is overmolded into the vane body.

10. The assembly of claim 1, wherein the sensor element is secured in a groove formed within the vane body.

11. A rotary vane pump comprising:

a rotor;

a rotor housing within which the rotor rotates;

the rotor having a plurality of radial slots;

a plurality of vanes each mounted in a respective one of the radial slots for reciprocal movement therein as the rotor rotates; and an assembly as claimed in claim 1 for detecting wear of the vanes as the rotary vane pump operates.

* * * * *